US010843498B2

(12) United States Patent
Bourg et al.

(10) Patent No.: US 10,843,498 B2
(45) Date of Patent: Nov. 24, 2020

(54) AUTOMATED PROCESS FOR THE MANUFACTURE OF AT LEAST ONE PRINTED WORK FROM AT LEAST ONE SHEET

(71) Applicant: C.P. BOURG S.A., Court-Saint-Etienne (BE)

(72) Inventors: Charles Bourg, Woluwe-Saint-Lambert (BE); Fabian Renard, Court-Saint-Etienne (BE)

(73) Assignee: C.P. Bourg S.A., Court-Saint-Etienne (BE)

( * ) Notice: Subject to any disclaimer, the term of this patent is extended or adjusted under 35 U.S.C. 154(b) by 0 days.

(21) Appl. No.: 16/407,529

(22) Filed: May 9, 2019

(65) Prior Publication Data

US 2019/0344600 A1 Nov. 14, 2019

(30) Foreign Application Priority Data

May 11, 2018 (BE) ..... 2018/5311

(51) Int. Cl.
*B42C 19/02* (2006.01)
*B42C 19/08* (2006.01)

(52) U.S. Cl.
CPC ..... *B42C 19/02* (2013.01); *B42C 19/08* (2013.01)

(58) Field of Classification Search
None
See application file for complete search history.

(56) References Cited

U.S. PATENT DOCUMENTS

| | | | | |
|---|---|---|---|---|
| 2006/0028662 | A1 | 2/2006 | Dobrovolsky | |
| 2007/0179037 | A1 | 8/2007 | Dobrovolsky | |
| 2012/0306141 | A1 | 12/2012 | McIntyre | |
| 2017/0129269 | A1* | 5/2017 | Dobrovolsky | B42C 5/00 |

FOREIGN PATENT DOCUMENTS

| | | |
|---|---|---|
| DE | 195 39 930 | 5/1996 |
| DE | 19539930 A1 | 5/1996 |
| DE | 102014111669 | 1/2016 |
| WO | WO 2011/108935 | 9/2011 |

OTHER PUBLICATIONS

U.S. Appl. No. 16/407,494, filed May 9, 2019, Bourg.

* cited by examiner

*Primary Examiner* — Lennin R RodriguezGonzalez
(74) *Attorney, Agent, or Firm* — McDonnell Boehnen Hulbert & Berghoff LLP

(57) ABSTRACT

The invention concerns a process and a system for the digital printing of printed publications, for the flexible production, on demand, of a single publication or small series of publications. The process of the invention is an automated process for the manufacture of at least one publication printed from at least one sheet, comprising the steps wherein:

- a plurality of pages (1, 4, 5, 8) of the publication is printed (A) on the sheet (10) that
- is moved through a series of stations wherein, subsequently,
- the sheet (10) is folded (C) in half perpendicular to the direction of travel;
- the folded sheet (10) is pivoted (D) by 90° with respect to the direction of travel, and
- the edges (18, 19) of the folded sheet are trimmed to obtain separate, superposed leaves (16, 17).

12 Claims, 4 Drawing Sheets

AUTOMATED PROCESS FOR THE MANUFACTURE OF AT LEAST ONE PRINTED WORK FROM AT LEAST ONE SHEET

CROSS-REFERENCE TO RELATED APPLICATION

This application claims priority to Belgium Patent Application No. 2018/5311, filed May 11, 2018, which is incorporated by reference herein in its entirety.

The invention concerns the field of digital printing of printed works, in particular the flexible production, on demand, of a single work or publication or small series of identical publications.

The manufacture of printed works, such as books, catalogs, personalized photo books or advertising brochures, requires a certain number of steps comprising the printing of content on a medium, in particular paper or cardboard, and the finishing of the work or publication. It may also comprise the assembly of several printed contents, reformatting, trimming of margins/unprinted edges, binding, gluing, stapling, folding, cutting, etc.

Offset technology, which has been used in printing for decades, makes it possible to print several pages of a publication on large format sheets, for example in A0 format, from a duly prepared blanket, so that folding the large format sheet after printing gives a a type of booklet also called a signature. The sheets may be printed on both sides. For large printed works, several signatures of different contents must be assembled before applying a binding finish, for example by sewing, gluing or stapling, with, if necessary, trimming the folded edges with a paper cutter. The production of the blanket being expensive, this technique is only of interest for the printing of a large number of identical publications.

Digital printing has changed the work of printers, making the printing of small series or even a single publication cost-effective. In effect, laser or inkjet printing techniques make it possible to avoid the use of a blanket. It is thus possible to print all the pages of the publication on a paper of a size close to the desired final format. Printers store several paper formats and choose the original format closest to the desired final size and adjust it, after printing, by trimming. For example, to make a standard paperback book, as no printer may print in A5 format, the printer selects an original sheet in A4, prints the contents of the book, superposes all the sheets in the correct order, trims the unprinted margins of the stack of sheets to keep only the final surface of the pages, glues the pages together or staples them and then folds them, and finally assembles them with the appropriate cover. This manufacturing process results in a great waste of paper. Since the trimming step is performed on the immobilized stack of sheets, it slows down the manufacturing process and generally requires the intervention of an operator who must move the stack of printed sheets to the paper cutter and then to the machine carrying out the binding.

The trend towards personalization of publications and minimum storage (lean manufacturing) means that printers are increasingly required to print on demand a single copy of each work or publication and thus be very flexible in their production methods. To do this, they must store several paper formats. The speeds are limited by the need to change the source paper format, as well as by the trims, which are usually carried out manually.

It was therefore considered necessary by the Applicant to propose a new process for the manufacture of publications to overcome the aforesaid drawbacks of the current processes.

For this purpose, the invention concerns an automated process for the manufacture of at least one printed work from at least one sheet, comprising the steps wherein:

- a plurality of pages of the printed work are printed on the sheet that
- is moved along a series of stations wherein, subsequently,
- the sheet is folded in half perpendicular to the moving direction;
- the folded sheet is pivoted 90° with respect to the moving direction and
- the edges of the folded sheet are trimmed to obtain separate, superposed leaves.

"Automated process" here means that the steps of the process are carried out by one or more machines and do not require, in their subsequent implementation, any human intervention. These steps may be carried out very quickly.

"Edges" refer to the lateral edges of the folded sheet parallel to the moving direction (direction of travel).

Trimming the edges is a well-known step for printers. These edges may be trimmed continuously by blades or knives, for example circular ones, while the sheet is moved. Edge trimming here not only eliminates bleed edges, i.e. margins that cannot be printed because of the technical limitations of printers, but also eliminates the edge of the folded sheet comprising the fold in order to obtain two superposed leaves that are not bound.

The leaves are thus here half-sheets, the lateral edges of which have been cut off. In the manufacturing chain, the two leaves will thus advance at the same speed as the original sheet. This is of great interest when finishing the publication, for example by gluing, a finishing which is generally limited in number of sheets per minute. Due to the process of the invention, the leaves arrive two by two, thus allowing the rate to be doubled.

It is therefore in the combination of the folding, pivoting and trimming the edges that the inventive activity of the process lies. Until now, in the field of digital printing, the size reduction of a page after printing was done exclusively by trimming and not by folding. The combination of the steps of the invention makes it possible to increase printing and manufacturing yield, wasting less paper and limiting the number of different formats to be stored.

The process of the invention makes it possible to manufacture a series of printed works, identical or different in content and/or in format. Each work may be manufactured from several sheets subjected successively to the steps of folding, pivoting and trimming the edges.

An important aspect of the invention is to be able to start from a single, starting sheet format, for example A0 or A3, and to obtain various output formats. Indeed, the steps of folding, pivoting and trimming the edges may be repeated several times. Therefore, the process of the invention may comprise additional steps wherein:

- the separate, superposed leaves are folded in half perpendicular to the moving direction;
- the separate, superposed, folded leaves are pivoted 90° relative to the moving direction and
- the edges of the folded sheet are trimmed to obtain separate, superposed leaves.

These steps allow the final format to be reduced and make it possible to obtain a smaller publication from the same original format.

Preferably, the sheet is moved along the direction of travel (moving direction), short edge first, mainly for technical reasons related to the paper dimensions.

"Short edge first" (SEF) or "short side first", means the shortest edge of the sheet that faces the direction of travel. Conversely, the term "long edge first" (LEF) or "long side first refers to the advancement of the sheet with its longest side arranged perpendicular to the direction of travel.

As far as possible, the printing of the sheets is done "long edge first" in order to optimize the printing rate. In this case, to apply the process of the invention, it is necessary to add a step of rotating the sheet 90° after printing.

The present invention also concerns an automated system for the manufacture of a printed work comprising:

means for printing a plurality of pages on one sheet;

means for moving the sheet through a series of stations comprising at least successively:

means for folding the sheet in half, perpendicular to the direction of travel;

means for pivoting the folded sheet 90° relative to the direction of travel and means for trimming the edges of the folded sheet.

Means for moving the sheet through a series of stations refers to means for displacing the sheet or feeding the sheet through the series of stations.

The invention will be better understood by means of the following description of the preferred embodiment of the invention, with reference to the accompanying drawing wherein.

Figure 1:
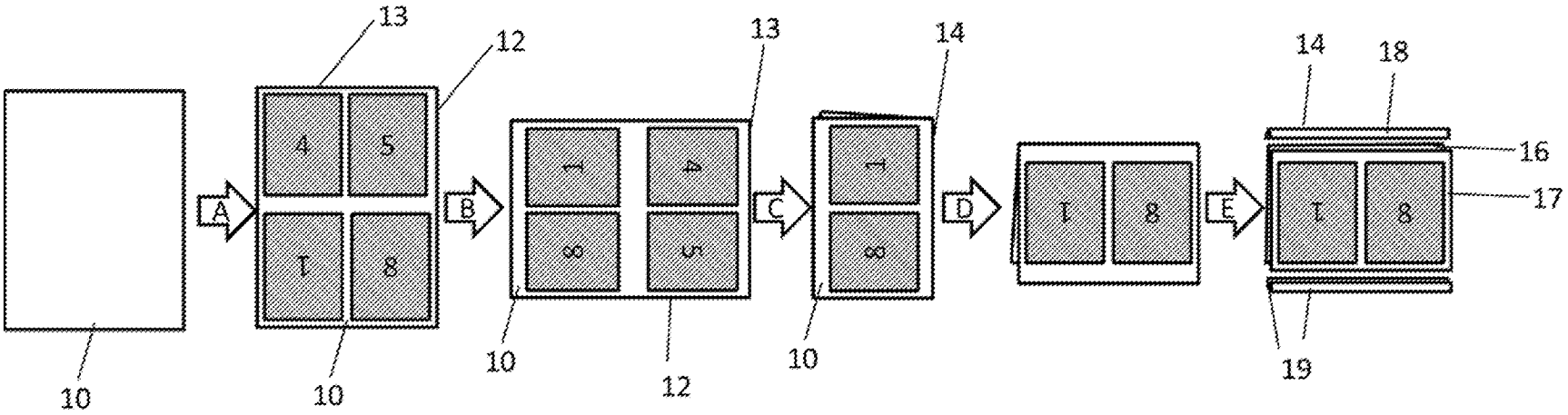
FIG. 1 illustrates the steps in the automated process of manufacturing a printed publication according to the first aspect of the invention.

In step A, a plurality of pages is printed on a sheet 10, here 8 pages arranged on both sides. Although only the front side is shown here, with the imposition of pages 1, 4, 5 and 8, it should be understood that pages 2, 3, 6 and 7 are imposed on the other side, directly on the back of pages 1, 4, 5 and 8 respectively. The sheet 10 is here, for example, in A3 format. It is printed with the long edge 12 first, the short edge 13 being parallel to the direction of travel of the sheet during printing.

When leaving the printer, the sheet travels through a series of successive stations allowing the implementation of the following steps.

In step B, the sheet 10 is held in its plane and pivoted 90° relative to the moving direction or direction of travel, here counter-clockwise, to position it "small edge 13 first". This step is necessary for the production of publications having a traditional format in their height-to-width ratio, such as books or catalogs. However, it is not necessary for other publications with less common formats, much taller than wide, such as some calendars or restaurant menus.

In step C, the sheet 10 is folded in half, perpendicular to the direction of travel. Half of the sheet comprising pages 4 and 5 is thus superposed on half of the sheet comprising pages 1 and 8. The folded edge 14 is shown here at the front, which facilitates feeding the folded sheet by the sheet moving means. If the folded edge 14 was at the rear, the front of the sheet would have two edges 15, which could cause manufacturing defects, such as paper creasing or misalignment if these two edges are not held exactly superposed when the sheet is fed. This problem does not occur when the folded edge 14 is at the front.

In step D, the sheet 10, folded in half, is pivoted 90°, here counter-clockwise, relative to the direction of travel.

In step E, the edges of the folded sheet thus oriented are trimmed to obtain separate, superposed leaves 16 and 17. The leaf 16 comprises here pages 4 and 5 (not shown) and the leaf 17 comprises pages 1 and 8. The folded edge 14 is thus separated from the leaves by trimming the edge 18, also comprising bleed edges or margins that are not needed in the printed work. Opposite bleed edges are also eliminated by separating the edges 19. It should be recalled, these "bleed edges" are margins that are not comprised in the editing of the publication but come from the technical constraints of printers. The importance of these bleed edges depends on the formats and printing techniques.

The leaves 16 and 17 thus superposed and separate are fed further on to one or more finishing stations or may again undergo folding, pivoting and edge-trimming steps. Compared to existing techniques, where only one leaf was obtained, the process of the invention produces, for a same printing feed rate, two superposed leaves with their edges at least partly removed. The yield is therefore doubled at this stage.

The A3 format described here is purely illustrative. Another starting format may be used, for example A0 or A4. Formats also include the untrimmed RA and SRA formats used by printers, which take into account the non-printable margins and technical constraints of printers.

The stations are shown here aligned along a linear direction of travel, but it is quite clear that the sheet does not necessarily move along a straight line. The sheet may be moved vertically, using mechanisms well known to printers, for example through the use of rollers. During the process, it may be positioned as required in a horizontal plane and then a vertical plane or any other plane suitable for the proper implementation of the process. As the printing paper is relatively flexible, the paper feed may be organized in all appropriate directions to optimize the process.

The sheet, folded or not, may also be fed laterally. For example, a 90° pivot may be done by rotating the sheet in a same plane while maintaining the same direction of travel but also by changing the direction of travel of the sheet by 90°, always in the same plane, i.e. by a 90° bend in the alignment of the stations.

The process is illustrated here for the imposition of eight pages on the sheet 10. "Page" refers to both pages with real content, such as, for example, text or images, as well as pages without content, i.e. blank pages.

Different options or alternatives will now be described regarding the continuation of the steps applicable to the leaves 16 and 17 obtained at the end of step E in order to obtain a printed work or publication. These options may be combined, in any order that seems proper to a person skilled in the art in order to obtain the desired result. In practice, the modules performing the different steps may be aligned and equipped with a "bypass" function, i.e. a sheet or superposed leaves may bypass one or more modules. The sequence of steps to which a sheet or leaves are subjected is automatically managed by a computerized publication manufacturing management system.

Figure 2:
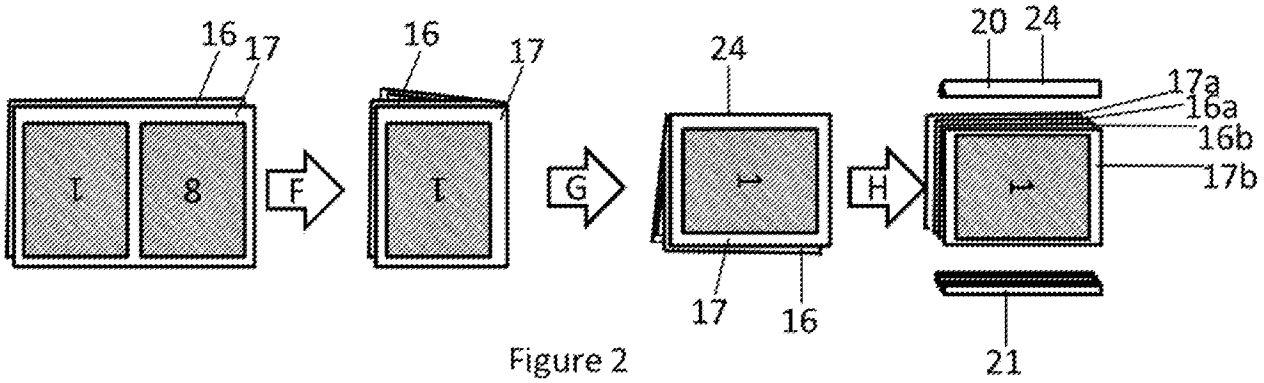
FIGS. 2 and 3 represent optional steps in the process in FIG. 1.

With reference to FIG. 2, a similar sequence of steps may be again applied.

In step F, the leaves 16 and 17 are folded in half perpendicular to the direction of travel, in order to superpose pages 1 of the leaf 17 and 4 of the leaf 16 with the pages 5 of the leaf 16 and 8 of the leaf 17. The pages obviously match well with their reverse sides as described above, but which will not be mentioned here for reasons of clarity. In a step F, the leaves 16 and 17 thus folded are pivoted by 90° with respect to the direction of travel.

In a step H, the edges of the leaves 16 and 17 thus folded along an edge 24 are trimmed to obtain four separate, superposed leaves 17*a*, 16*a*, 16*b* and 17*b*. The folded edge 24 is thus separated from the leaves by trimming the edge 20, which also comprises bleed edges or margins that are not needed in the publication. The opposite bleed edges are also eliminated by separating the four superposed edges 21.

Thus, by duplicating the folding, rotating and edge-trimming sequence, four superposed leaves are obtained, for a same printing feed rate. These may then be subjected to finishing steps well known to a person skilled in the art.

Figure 3:
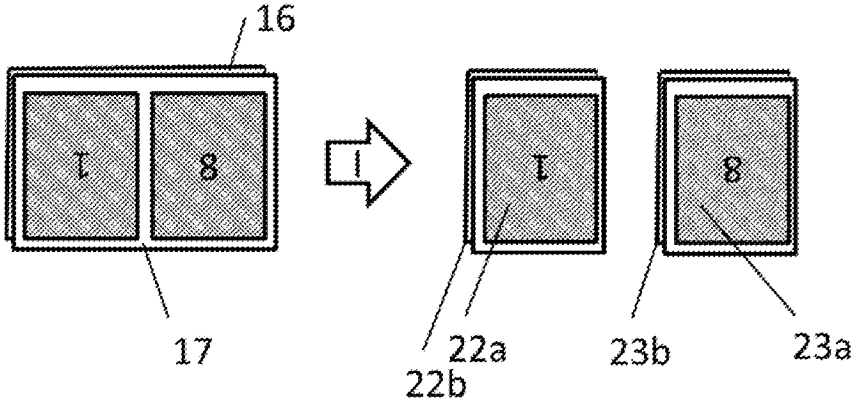

With reference to FIG. 3, in a step I, the superposed leaves 16 and 17 may be cut perpendicular to the direction of travel. In order not to slow down the movement along this direction, a helical knife may be used to make this cut. Such a knife consists of a blade installed along a roller under which a sheet or leaves pass. The roller is arranged substantially, but not exactly, perpendicular to the direction of travel. The blade is arranged on the roller so as to cut the moving sheet or sheets, perpendicular to the direction of travel, by rotating the roller. The blade is thus helically arranged along the length of the roller. It is not necessary for the blade to fully wind around the roller. In a module comprising such a knife, a sensor may be arranged to detect the arrival of the leaf and allow the synchronization of the rotation of the roller to cut the sheets or leaves at the desired location.

The use of a helical knife module makes it possible, compared to the use of a guillotine knife, to avoid stopping the sheet feed or waiting for a stack of sheets to be cut and thus does not to slow down the manufacturing rate.

In some cases, a creasing step may also be added, especially before a folding step, or in anticipation of a subsequent folding. Creasing consists in making a groove in a sheet or a leaf to facilitate folding and/or to prevent the paper or cardboard from being damaged during folding. This step is well known to a person skilled in the art and commonly applied in printing.

As far as the pivoting step is concerned, it may be implemented by any suitable system known to a person skilled in the art. In particular, it is common to use roller registration/rotation systems to position the printed sheets against the registration edge. A large number of rollers are arranged, slightly inclined in order to move the edge of the paper. Among these rollers, some rubber-type rollers are inserted, which may rotate at higher speeds in order to drive one edge of the sheet faster than the other and thus induce a rotation of the sheet. The registration system thus makes it possible to both align and pivot the printed sheet. A similar roller system may also be used to pivot several superposed leaves.

The folding step may be implemented by any system known to a person skilled in the art, such as a buckle folder. In a buckle folder, a sheet arriving in abutment is deformed to buckle under the effect of the feed force. The buckle is then "trapped" between two rollers that pinch the sheet at the fold and thus complete the folding.

Thus, a registration/rotation system may be combined with a folding machine, an edge trimming system. Each system may be repeated several times. One or more creasing and/or helical cutting systems may also be added, as well as any other system relevant for a person skilled in the art.

These systems may be arranged in series and driven by a computer system or server. In particular, as the assembly allows a high degree of flexibility and the manufacture of a wide variety of types of publications, certain modules or systems may be bypassed or active on a case-by-case basis.

Figure 5:
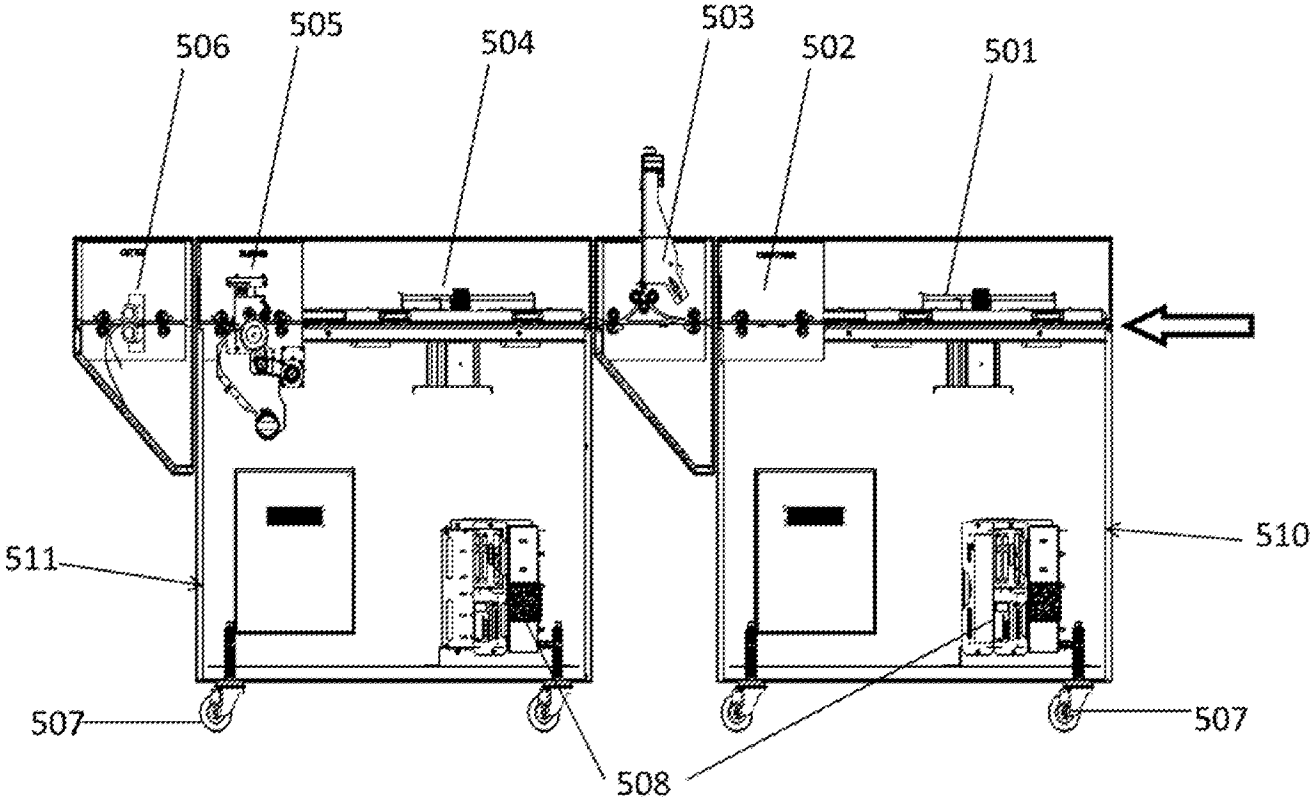
FIG. 5 represents a system according to the invention.

For example, with reference to FIG. 5, a system may comprise, one next to the other, two blocks 510 and 511 at the output of the printer (not shown). The first block 510 comprises a registration station or module 501 with or without rotation, a conveyor 502 and a buckle folder 503. The second block 511 comprises a sheet registration and rotation module 504, an edge-trimming module 505 and a helical knife 506. Each of these modules has the functions described above and together they allow the implementation of the process of the invention. Note that some optional modules, such as the helical knife 506, may be "bypassed", i.e. a sheet or leaf may pass through this module without any action being applied thereto. The blocks 510 and 511 are shown here on castors 507, to illustrate the high flexibility of the system. Other blocks offering additional features may easily be added or inserted.

Due to the invention, using one sheet of the same format, a wide variety of formats and types of leaves may be obtained from the whole.

The steps described above are followed by finishing steps to form a content block of the printed publication, comprising in particular the binding of the leaves.

The steps described above lead to obtaining several superposed leaves. Since digital printing allows printing all the pages of a publication one after the other, the sheets are processed successively and lead to the stacking of all the leaves forming the publication.

The stacked leaves are then joined together to form the content block of the publication. Binding may be done in several ways, such as, for example, by gluing or stapling. These binding steps are well known to a person skilled in the art.

The manufacture of the publication is completed with the assembly of the content block with a cover, if the publication comprises one. As the cover of the publication is printed separately, several methods are used to complete this assembly.

In general, the leaves composing the inside of the publication are printed and prepared by a different system than the one used to prepare the cover of the publication. When a single publication is printed in numerous copies, it is quite simple to assemble the contents of the publication with its cover, starting from a stock of contents and a stock of covers.

As modern systems aim to be flexible and allow for the on-demand printing of a single copy of a publication, managing the assembly of the content with the cover becomes more complex. This includes optimizing printing resources to produce many publications in a row, all different.

Systems exist, wherein the publication covers are printed by a first printing system and stacked in a certain order in a cover storage rack. The first cover of the stack is identified by detection means, such as a barcode reader. Identification triggers the printing/manufacture of the publication's content by a second system. The content and the cover are then assembled. The same steps are repeated for the following covers of the stack.

These systems have a certain number of drawbacks that alter production efficiency. Take, for example, a list of five pending publications, comprising, for example, two publications to be bound by gluing, one publication to be bound by stapling and then two publications to be bound by gluing. The five covers are printed and stacked in order in a storage rack. The first two covers will subsequently be identified, the associated content will be prepared and assembled with the corresponding cover. If the stapling function is temporarily unavailable, the third cover will be identified, but the associated content will not be prepared and the entire system will be put on hold until the stapling function becomes available, as the two covers remaining in the stack cannot be processed until the third cover is assembled with its content. Existing systems therefore cannot manage hardware downtime on either system.

The existing systems also do not know how to manage priorities, which could be assigned, for example, according to customers, nor do they know how to manage different formats.

The Applicant therefore also considered it necessary to improve the efficiency of the stage of assembling the cover and content of a printed publication.

To this end, the invention proposes an automated method for the production of printed publications, each consisting of a content block and a cover, according to which:

- the feasibility of manufacturing the content blocks of the publications is determined,
- an order of priority is established for the manufacture of the publications,
- the covers to be assembled with the content blocks are manufactured,
- the manufacture of the content blocks is ordered in descending order of priority subject to feasibility, which takes precedence over manufacturing priority, and
- the content blocks are assembled with the corresponding covers.

The method is managed by a computer server that receives, for each publication, manufacturing information for the content block, manufacturing information for the cover and manufacturing priority information for the publication.

"Content block" refers here, as mentioned above, to the entire publication with the exception of the cover.

"Feasibility" here means the technical capacity of the equipment to produce the content block. To determine the feasibility of manufacturing content blocks, the content block manufacturing system transmits to the computer server information on the availability of the functions thereof.

The covers are placed in separate racks of a cover sorter, so that they may be removed at will.

Thus, due to the process of the invention, if, because of a material reason of unavailability of certain functions of the manufacturing system, a part of the publications may not be manufactured, the other publications may still be produced. When a function of the content block manufacturing system becomes available again, for example, after maintenance has taken place or if a heating device has reached the temperature required for printing, the feasibility of the content blocks is reassessed, and the list of content block manufacturing orders is updated according to the order of priority. In a "chain" manufacturing context, the unavailability of a function, even for a short period of time, does not thus block the process. This makes it possible, among other things, to avoid production backlogs by optimizing the capacities of the manufacturing system.

Figure 4:
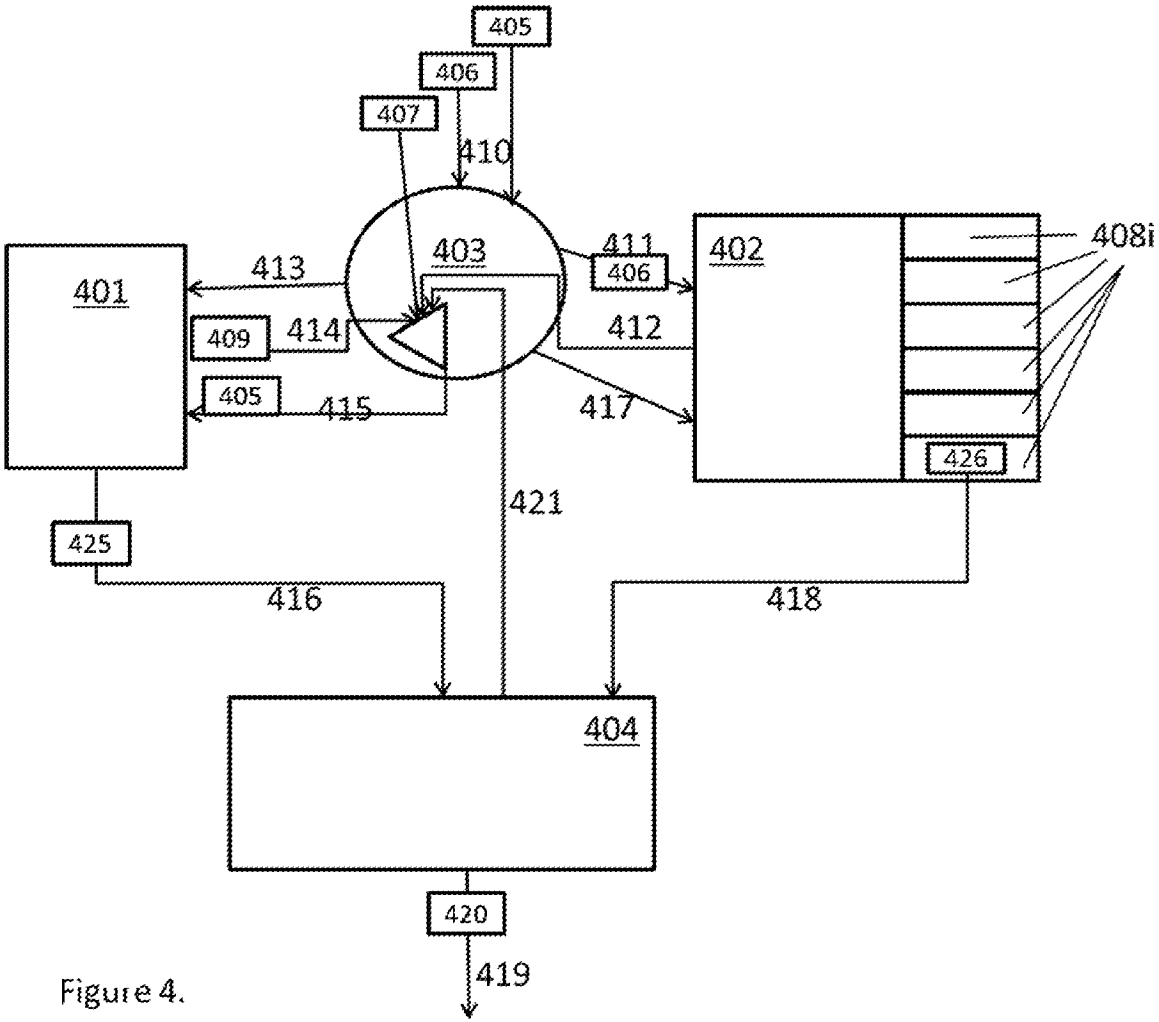
FIG. 4 is a block diagram of the method of the second aspect of the invention.

The invention will be better understood with the help of FIG. 4 illustrating the process of the invention.

With reference to FIG. 4, the automated process for producing printed works or publications, each consisting of a content block 425 and a cover 426, comprises the following steps.

First, in step 410, a computer server 403 receives, for each work, information 405 for manufacturing the content block 425, information 406 for manufacturing the cover 426 and information 407 on the manufacturing priority of the publication.

The manufacturing information for the content block comprises all the information relating to the content, format, layout and binding of the pages, as well as information relating to the steps to be taken, for example, their nature or their order, to obtain the content block ready to be assembled with the cover.

Similarly, the manufacturing information for the cover comprises all the information related to the content and to the format. It may also contain information relating to the mode of assembly of the cover and the content block.

The manufacturing priority information for the publication comprises, for example, the time frame within which manufacturing must be completed, the relative manufacturing priority of the works in relation to each other, for example, for customers who have paid more for faster delivery.

In step 411, the computer server 403 sends the manufacturing information 406 for the cover 426 to a cover manufacturing system 402, which manufactures the cover 426 and places it in one of the racks **408*i* of a cover sorter. Six racks 408*i* are shown here, but many more may be envisaged, depending on the requirements. The system 402 may, at step 412**, indicate the manufacturing of the cover and/or an identifier of the rack in which it is placed.

The cover manufacturing system is typically a system allowing the content of the cover to be printed on the appropriate medium and the format thereof to be adjusted. It may also possibly comprise creasing means, to facilitate the folding of the cover around the content block, or surface treatment means (film coating, lamination, etc.) or any other means deemed necessary by a person skilled in the art.

The racks of a cover sorter here refer to storage bins intended to separate the printed covers. Unlike in the existing systems, in which all printed covers are stacked one on top of another in a single rack as they are printed, here each cover is placed in a separate rack. This allows for covers to be removed separately at will, regardless of the order in which they were printed, and for various cover formats to be managed. It may be provided that each rack may only receive one cover, or that each rack may receive several identical covers. It may also be provided that each rack may receive several different covers, of a same format, or of different formats, or that each rack may receive all the covers corresponding to content blocks manufactured in the same sequence of steps, or any other arrangement deemed appropriate, depending on the circumstances.

In step 413, the computer server 402 asks a content block manufacturing system 401 for information 409 on the availability of the functions thereof. The content block manufacturing system 401 returns (step 414) the information 409 on the availability of its functions to the computer server 103.

The information on the availability of the functions of the content block manufacturing system refers here to a report on the operation of the elements comprised in the content block manufacturing system. This information may, for example, comprise the paper level, the ink levels available in the printer depending on the colors, the temperature of certain elements, paper jam information for a particular module, etc. Similarly, in step 421, the computer server 402 may request from the finishing system 404 information on the availability of the functions thereof. The finishing system 404 is the module in which the covers are assembled with the content blocks.

The information on the availability of the functions of the publication finishing system 404 refers here to a report on the operation of the elements comprised in the publication finishing system. This information may, for example, comprise the functional availability of the different modules, the levels of consumables (glue, staples) available, the temperature of certain elements, paper jam information for a particular module, etc.

The computer server 403 analyzes the manufacturing priority information 407 based on the information 409 on the availability of the functions of the content block manufacturing system, the information 412 on the availability of the covers, and the information 421 on the availability of the functions of the finishing system 404 to establish an order of priority and select the content blocks 425 feasible to manufacture.

In step 415, the computer server 403 orders the system 401 to manufacture the selected content block 425.

The content block manufacturing system here refers to all the means necessary for printing, formatting, assembling and finishing the content block starting from a sheet. This may, for example, be a system as described above. It may also be any fully or partially automated system that may be used in printing to prepare the content block. Preferably, the content block manufacturing system is the system described above comprising printing, folding, pivoting and edge-trimming means.

The system 401 manufactures the content block 425 and sends it to step 416 toward the finishing module 404.

At step 417, the computer server 403 orders the removal of the cover 426 corresponding to the selected content block 425 from its rack 408*i*.

In step 418, the system 402 extracts the cover from the rack 408*i* and sends it to the finishing module 404. Note that the physical step of extracting the cover to place it in the finishing module 404 may take place before ordering the manufacture of the content block, during its manufacture or even after the manufacture of the content block. Depending on the type of finishing system, it may be advantageous to use one or the other option.

In step 419, the cover and content block are assembled in the finishing module 404 to form the printed publication. Such finishing or assembly modules are well known to a person skilled in the art.

It should be noted here that the speed at which the server receives the instructions for manufacturing publications is not correlated with the actual speed of manufacture of these publications, hence the need to establish priorities in implementing the manufacturing of content blocks and covers. In particular, the following elements should be considered when envisaging all the advantages of the method of the invention:

- the computer server may receive almost simultaneously the order to manufacture a large number of publications that are different from each other;
- the manufacture of a content block, even if fully automated, takes a certain amount of time (from a few seconds to a few minutes) which is generally longer than the time required to manufacture a cover, and
- the throughput rates currently required, as well as the pressure on the costs in the field of flexible digital printing, do not allow for the underutilization of the equipment.

It is thus necessary to synchronize all the manufacturing steps of the publication as closely as possible. Compared to systems where the final assembly of the publication is determined by the availability of the cover at the top of a pile of covers, the process of the invention allows that neither the unavailability of the cover nor the unavailability of certain functions of the equipment are factors limiting the productivity of the manufacturing chain.

In the same way as the feasibility of the content blocks, the feasibility of the covers may also be communicated to the server by the cover manufacturing system. The feasibility of the covers may also be analyzed and used in the selection of content blocks to be manufactured. For example, it seems wise to try to avoid, for example, filling all the cover racks if none of the corresponding content blocks are feasible. It is therefore possible to order the manufacture of covers subject to the feasibility thereof and/or the availability of cover storage facilities.

It is obvious to a person skilled in the art that some of the steps described above may occur at the same time, and that the systems described may operate continuously. Examples of applications of the method of the invention are, but are not limited to, the production of personalized photo albums, the production or reprinting of books "on demand".

With regard to practical embodiments for carrying out the extraction of the cover 426 from the rack 408*i* at step 418, several methods may be applicable. For example, a publication may have a unique identifier associated with the content and with the cover thereof. The server stores this identifier in memory and temporarily associates it with the specific rack where the cover is placed. When the manufacture of the content corresponding to this identifier is initiated, this same identifier is reused to identify the rack where the cover is placed in order to extract it.

The unique identifier may, for example, be a bar code, a QR code, the ISBN code of the publication if it is a published book, or any other code that a person skilled in the art may consider.

Storing covers in multiple racks makes it possible to produce covers in different formats, which was not possible with the existing systems.

The invention claimed is:

1. Automated process for the manufacture of at least one printed work from at least one sheet, comprising the steps wherein:

- a plurality of pages (1, 4, 5, 8) of the work is printed (A) on the sheet (10) that
- is moved through a series of stations wherein, subsequently,
- the sheet (10) is folded (C) in half perpendicular to the moving direction;
- the folded sheet (10) is pivoted (D) by 90° with respect to the moving direction, and
- the edges (18, 19) of the folded sheet are trimmed to obtain separate, superposed leaves (16, 17).

2. Process according to claim 1, wherein the printed work is made from several sheets, each sheet being subjected to the same steps.

3. A process according to claim 1, wherein several printed works are manufactured, all the sheets of the work being successively subjected to the same steps.

4. Process according to claim 3, wherein covers (426) are assembled with the content blocks (425) of the printed works.

5. Process according to claim 4, wherein, for assembling the covers (426) with the content blocks (425):

the feasibilities (409) of manufacturing the content blocks (425) of the printed works is determined;

an order of priority (407) is established for the manufacture of the printed works;

the covers (426) to be assembled with the content blocks are manufactured;

the manufacture of the content blocks is ordered (413) in descending order of priority subject to feasibility, which takes precedence over manufacturing priority, and the content blocks are assembled with the corresponding covers.

6. Process according to claim 5, wherein the covers (426) are stored in racks (408*i*) of a cover sorter separately from each other to be removed at will.

7. A process according to claim 1, wherein the sheet (10) is pivoted (B) by 90° after it is printed.

8. Process according to claim 1, comprising further steps wherein:

the separate, superposed leaves (16, 17) are folded (F) in half perpendicular to the moving direction;

the separate, superposed, folded leaves (10, 17) are rotated (G) 90° relative to the moving direction and the edges (20, 21) of the folded sheet are trimmed (H) to obtain separate, superposed leaves (17*a*, 17*b*, 16*a*, 16*b*).

9. Process according to claim 1, wherein the sheet (10) is moved with short edge (13) first.

10. Process according to claim 1, wherein the leaves (16, 17; 16*a*, 16*b*, 17*a*, 17*b*) are subjected to a finishing step which binds them together into a content block.

11. Automated system for the manufacture of a printed publication comprising:

means for printing a plurality of pages on one sheet;

means for moving the sheet through a series of stations comprising at least successively:

means for folding the sheet in half, perpendicular to the direction of travel;

means for pivoting the folded sheet 90° relative to the moving direction and means for trimming the edges of the folded sheet to obtain separate, superposed leaves after folding the sheet in half, perpendicular to the direction of travel and pivoting the folded sheet 90° relative to the moving direction.

12. Automated system according to claim 11, comprising at least one of the means of the list consisting of creasing means, binding means, assembly means and finishing means.

* * * * *